United States Patent [19]

Kaminski

[11] Patent Number: 5,038,151

[45] Date of Patent: Aug. 6, 1991

[54] SIMULTANEOUS TRANSMIT AND RECEIVE ANTENNA

[75] Inventor: Walter J. Kaminski, Fremont, Calif.

[73] Assignee: Loral Aerospace Corp., New York, N.Y.

[21] Appl. No.: 387,557

[22] Filed: Jul. 31, 1989

[51] Int. Cl.[5] ..... H01Q 21/28

[52] U.S. Cl. ..... 343/727; 343/813; 343/841; 343/853; 343/890

[58] Field of Search ..... 343/727, 890, 891, 813, 343/814, 853, 841, 767, 797, 799, 820, 827

[56] References Cited

U.S. PATENT DOCUMENTS

| | | | |
|---|---|---|---|
| 2,498,655 | 2/1950 | Faymoreau | 343/853 |
| 2,515,344 | 7/1950 | Guanella et al. | 343/727 |
| 2,785,399 | 3/1957 | Harris | 343/813 |
| 3,019,437 | 1/1962 | Hoadley | 343/725 |
| 3,105,236 | 9/1963 | McCloud | 343/725 |
| 3,124,802 | 3/1964 | Van Dallarmi | 343/876 |
| 3,380,051 | 4/1968 | Cartwright | 343/727 |
| 3,691,561 | 9/1972 | Jager | 343/727 |
| 3,803,617 | 4/1974 | Fletcher | 343/730 |
| 4,129,871 | 12/1978 | Johns | 343/727 |
| 4,155,092 | 5/1979 | Blaese | 343/799 |
| 4,203,118 | 5/1980 | Alford | 343/727 |
| 4,410,893 | 10/1983 | Grippee | 343/792 |
| 4,814,777 | 3/1989 | Monser | 343/727 |

FOREIGN PATENT DOCUMENTS

| | | | |
|---|---|---|---|
| 592188 | 2/1960 | Canada | 343/727 |
| 0117240 | 8/1984 | European Pat. Off. | 343/848 |
| 825282 | 12/1951 | Fed. Rep. of Germany | 343/799 |
| 2757325 | 7/1979 | Fed. Rep. of Germany | 343/853 |

OTHER PUBLICATIONS

ARRL Handbook 55th Ed., published by the ARRL, Newington, CT, 1978, pp. 437,438.

*Antenna engineering Handbook,* Johnson & Jasik Eds., McGraw Hill Book Co., 2D Ed., 1984 (Excerpts enclosed).

*Primary Examiner*—Michael C. Wimer

*Attorney, Agent, or Firm*—Edward J. Radlo; Dennis S. Fernandez

[57] ABSTRACT

A stationary, lightweight, easily transportatable antenna capable of full duplex operation, i.e., portions of the antenna can transmit and receive simultaneously in the same frequency band. The antenna has a near omnidirectional pattern in the azimuth plane for both transmit and receive. The receive portion (2) consists of four antenna elements (20), each having a beamwidth in the azimuth plane slightly greater than 90°. The receive antennas (20) are arranged symmetrically about a midpoint (93) that lies in the azimuth plane. The beams of the four receive antennas (20) face outwardly away from the midpoint (93) and thereby cover the full azimuth plane. The transmit portion (1) of the antenna is a colinear set of dipole elements (12) arranged within a cylinder (11) that is orthogonal to the azimuth plane and centered on said midpoint (93). A nulling circuit (3) intrinsic to the receive portion (2) provides further isolation between transmit and receive, by means of phasing geometrically opposing receive antennas (20) 180° out-of-phase with respect to each other.

7 Claims, 3 Drawing Sheets

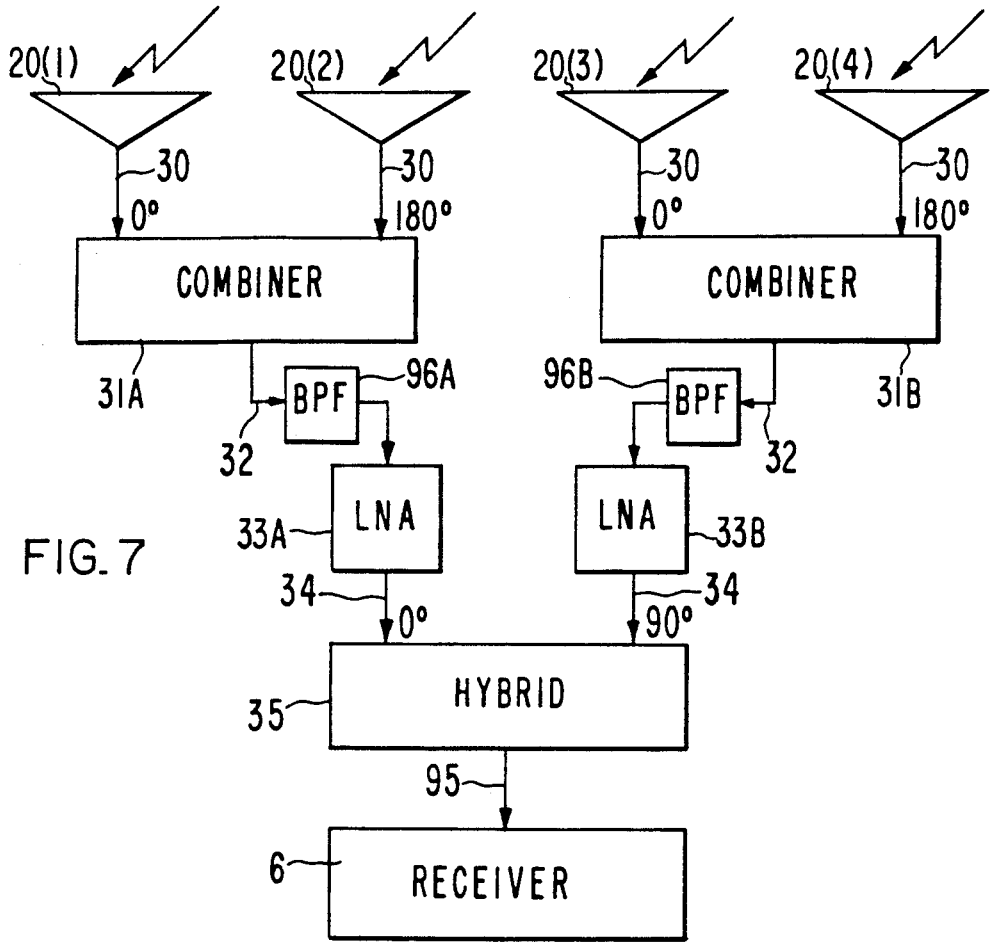
FIG. 7
FIG. 8
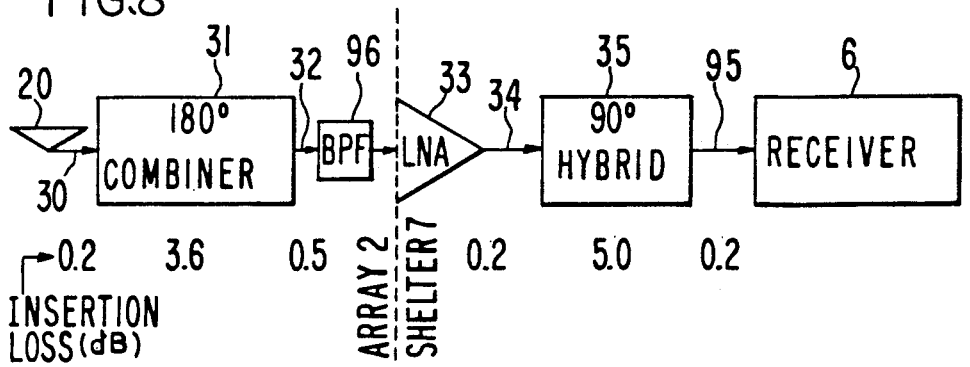

SIMULTANEOUS TRANSMIT AND RECEIVE ANTENNA

DESCRIPTION

1. Technical Field

This invention pertains to the field of omnidirectional antennas that can be used for transmit and receive simultaneously on the same frequency band.

2. Background Art

U.S. Pat. No. 2,498,655 describes an antenna array which must be rotated to obtain more than unidirectional coverage. The cable feeding the uppermost antenna element uses the feed of the next lower antenna element as a shield, preventing it from leaking its signal into the lower antenna elements. This cable feeding arrangement narrows the bandwidth of the antenna compared ~~with~~ the present invention. Multiwavelength spacing would have to be used in order to obtain the capability of simultaneously transmitting and receiving in the same band, to prevent mutual coupling.

U.S. Pat. No. 3,019,437 discloses an antenna having a truncated conical surface of revolution within a cylindrical surface of revolution, a "horn within a horn". Although providing for full duplex operation (simultaneous transmit and receive in the same frequency band), the antenna is unidirectional. Isolation between transmit and receive is accomplished by means of feeding the cylindrical surface of revolution by the outer conductor of the cable that feeds the truncated conical surface of revolution. This is a narrow banded approach compared with the isolation scheme of the present invention.

U.S. Pat. No. 3,105,236 discloses a monopole antenna within a loop antenna. Since the E field radiation pattern of the loop antenna is directional, rotation is required in order to obtain omnidirectionality. The antenna of the present invention, on the other hand, is nearly omnidirectional even though it is stationary, and therefore is simpler to construct. In the reference patent, isolation is provided by means of the monopole introducing into the loop opposing currents which add to zero. This forces the bandwidth to be narrower than in the present invention. Since the antennas are coupled so closely that the capacitive and inductive fields have to be precisely balanced (column 1 lines 40–50), only a very narrow frequency band of operation is possible for optimum isolation between transmit and receive.

U.S. Pat. No. 3,124,802 discloses a transmit-only antenna array comprising a plurality of dipoles alternately disposed along a mast, to fill null positions in the vertical plane.

U S. Pat. No. 3,803,617 discloses an antenna array which operates in three separate frequency bands. Simultaneous transmit and receive is achieved by using one band for transmit and another band for receive. Therefore, isolation is obtained by band separation. The reference antenna is directional and has a narrower bandwidth than the antenna of the present invention.

U S. Pat. No. 4,129,871 discloses a transmit-only antenna array for use in transmitting circularly polarized waves for purposes of improving television reception in large metropolitan areas.

U.S. Pat. No. 4,155,092 discloses an antenna that is capable of half duplex operation, but not full duplex operation as in the present invention: the reference antenna operates either as a transmit antenna or as a receive antenna, but not both at the same time.

U.S. Pat. No. 4,203,118 discloses a transmit-only array.

U.S. Pat. No. 4,410,893 discloses an antenna which normally operates in half duplex mode. Although the antenna may have limited ability to transmit and receive simultaneously, this must be done in different frequency bands, not in the same frequency band as in the present invention. In such an event, isolation is obtained by band separation.

The above prior art can be summarized by observing that U.S. Pat. Nos. 3,124,802, 3,803,617, 4,129,871, 4,155,092, 4,203,118, and 4,410,893 are not capable of full duplex operation as in the present invention. U.S. Pat. Nos. 2,498,655, 3,019,437, and 3,105,236 disclose antennas that, while capable of full duplex operation, are not omnidirectional in coverage unless physically rotated. The present invention, on the other hand, offers near omnidirectionality in a stationary, easy to build antenna.

*Antenna Engineering Handbook,* Johnson & Jasik eds., McGraw Hill Book Co., 2d ed. 1984 (excerpts enclosed), illustrates examples of panel antennas 20 that can be advantageously used in the present invention.

DISCLOSURE OF INVENTION

The present invention is a stationary antenna capable of full duplex operation. The antenna has a near omnidirectional radiation pattern in the azimuth plane for both transmitting and receiving. The antenna comprises a receive array (2) consisting of four receive antenna elements (20), each having a beamwidth that is approximately 90° in the azimuth plane. The receive antenna elements (20) are arranged symmetrically about a midpoint (93) lying in the azimuth plane. The beams of the four antenna elements (20) face away from the midpoint (93) and cover the full azimuth plane. The antenna further comprises a transmit dipole array (1) consisting of a colinear set of dipole elements (12) arranged within a non-conductive cylinder (11) that is orthogonal to the azimuth plane and centered on said midpoint (93).

BRIEF DESCRIPTION OF THE DRAWINGS

These and other more detailed and specific objects and features of the present invention are more fully disclosed in the following specification, reference being had to the accompanying drawings, in which:

FIG. 7 is a block diagram sketch of nulling circuit 3 of the present invention; and FIG. 8 is a sketch showing insertion losses at various stages within nulling circuit 3.

BEST MODE FOR CARRYING OUT THE INVENTION

The present invention is an antenna capable of full duplex operation. By that is meant that a portion of the antenna can be used for transmit and another portion used for receive, simultaneously, with the transmit and receive frequencies within the same frequency band. A typical frequency band, and one for which the preferred embodiment described herein has been designed, is 225 MHz to 400 MHz. Such an antenna can be used, for example, for spread spectrum (frequency hopping) radios. For the preferred embodiment described herein, the transmit/receive port-to-port isolation is at least 60 dB over a 56% bandwidth. 60 dB isolation provides 70 dB of spur free dynamic range in a receiver having a +15 dBm two tone third order input intercept while connected to receive array 2 when two ten watt signals emit from transmit array 1.

The antenna has no moving parts, is lightweight, and is easily transportable.

Figure 1:
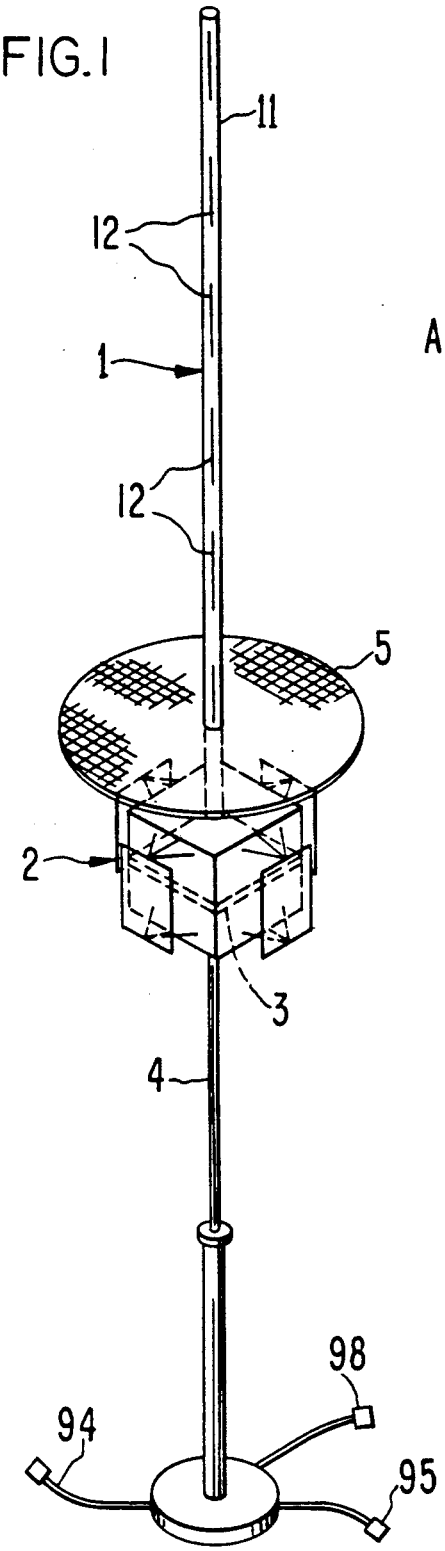
FIG. 1 is an isometric view of the antenna of the present invention.

The transmit portion of the antenna is a colinear dipole array 1. As seen in FIG. 1, array 1 comprises a set of linear dipole elements 12. There can be anywhere from one to a very large number of dipole elements 12 within the set. When more than one dipole element 12 is present, the elements 12 are colinear. The result of introducing additional dipole elements 12 into the set is that the transmit pattern will be narrowed in the elevation plane, and there will be better isolation with respect to the receive portion of the antenna.

The dipole elements 12 are typically positioned within a hollow non-conductive cylinder 11. Each element 12 is center fed by means of a matching transformer and coaxial cable 94. The sections of cable 94 are connected at appropriate lengths to preserve the proper phasing characteristics, forming a composite feed cable 94 which is also positioned within cylinder 11. The composite feed cable 94 passes through receive array 2 and through supporting mast 4. The feed cable 94 connections within cylinder 11 are not illustrated in FIG. 1 in order to avoid cluttering the drawing.

Figure 3:
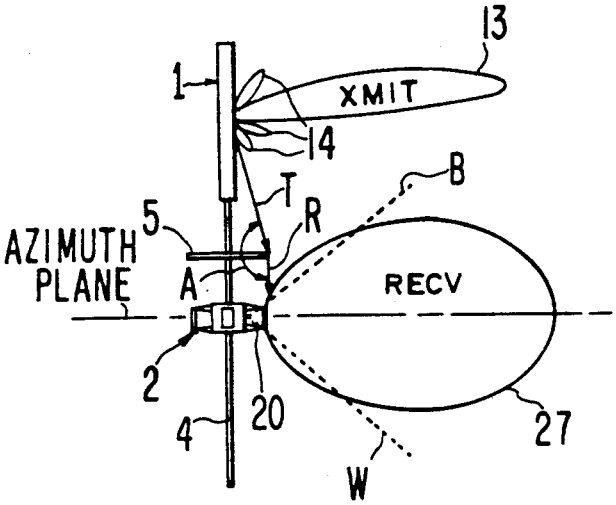
FIG. 3 is a side view sketch illustrating one-half of the principal E-plane transmit and receive lobes of the present antenna in the elevation plane.

The pattern of array 1 in the azimuth plane is omnidirectional. One-half (the righthand side) of the elevation pattern is illustrated in FIG. 3, in which it is seen that a major lobe 13 is nearly parallel to the azimuth plane. Several minor lobes 14 are present and are very small compared with major lobe 13. In FIG. 3, vector T is the pattern null transmit vector.

Diffraction grating 5 is optional, and if present, is positioned parallel to the azimuth plane, physically separating transmit dipole array 1 from receive array 2. Diffraction grating 5 is a rigid planar circular screen, non-resonant in the band of interest and having small holes (e.g., less than one-tenth of a wavelength in diameter) to provide shielding between the transmit and receive lobes 13,27, respectively. A solid metal plate could be used in lieu of diffraction grating 5, but would be too heavy for most transportable applications. Therefore, a foraminous diffraction grating 5 is used to save weight.

Mast 4 is preferably a grounded metallic hollow cylinder through which passes the coaxial feed cables 94,95 and DC feed cable 98 for the transmit and receive arrays 1,2, and nulling circuit 3, respectively. DC feed cable 98 provides power to active circuits in nulling circuit 3. Mast 4 provides physical support for the antenna and is electrically isolated from the dipole elements 12. Mast 4 can be of the collapsible variety, to facilitate portability.

Figure 4:
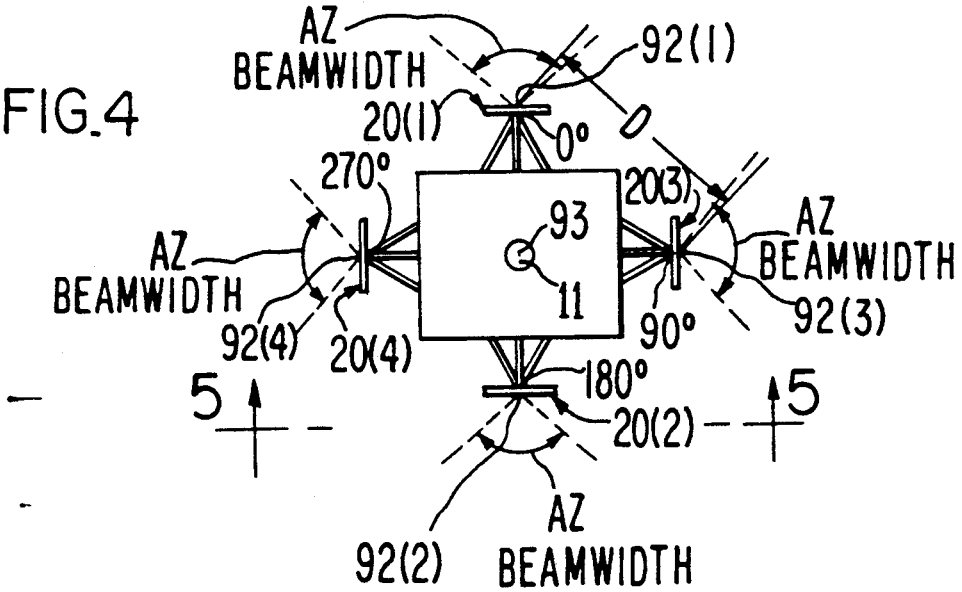
FIG. 4 is a top planar view of receive array 2 of the present invention.

Receive array 2 comprises four substantially identical antennas 20 each having approximately a 90° beamwidth in the azimuth plane. As seen in FIG. 4, the receive antennas 20 are arranged symmetrically about a midpoint 93 lying in the azimuth plane, with their beams facing outwardly. The symmetry of the arrangement means that the four 90° beamwidths together cover the entire azimuth plane. In practice, beamwidths of slightly greater than 90° are used, to avoid null regions. FIG. 4 also shows that cylinder 11, which is orthogonal to the azimuth plane, is centered on said midpoint 93. This desirably maximizes isolation between transmit and receive by causing a balanced phase and amplitude relationship. Guying of array 1 can advantageously be employed to insure that the electrical phase between arrays 1 and 2 does not change by an appreciable amount.

FIG. 3 illustrates that in the preferred embodiment, the elevation beamwidth of each antenna 20 is slightly less than 90° in the elevation plane. The major lobe of one of the receive antennas 20 is designated as item 27, and the elevation beamwidth falls between lines B and W. Vector R is the pattern null receive vector. A, the angle between vectors T and R, is made less than 180° when diffraction grating 5 is used. This factor desirably makes for enhanced free space isolation between transmit and receive.

Figure 2:
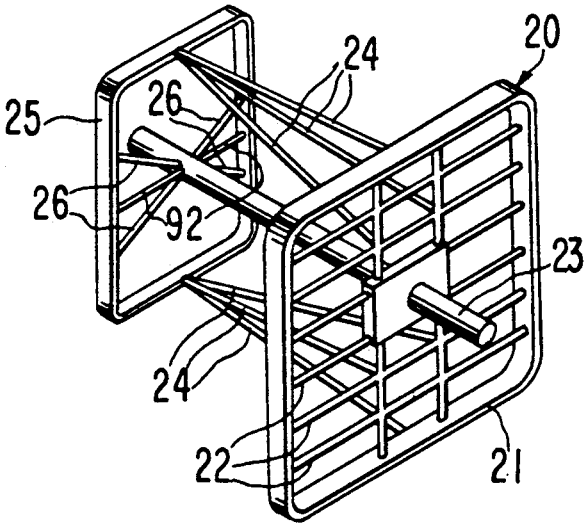
FIG. 2 is an isometric view of a panel antenna which can advantageously be used as one of the receive antenna elements 20 of the present invention.

A suitable receive antenna 20 meeting the above requirements is the panel antenna illustrated in FIG. 2. Other antennas 20 can also be used, such as horns at the higher frequencies. The panel antenna 20 comprises a planar conductive grid 22 facing the inside of the array 2, spaced apart from and parallel to a skeleton slot 25. The grid 22 is surrounded by a generally square conductive outer frame 21.

Cylindrical feed cable 23 is orthogonal to grid 22 and the planar portion of slot 25. Two balanced feed conductors 92 pass through cable 23 and connect to cable 23 via a balun at the midpoint of slot 25. Slot 25 is generally oblong, i.e., a non-square rectangle. Four non-conductive support spreaders 26 connect the conductive outer shield of cable 23 with conductive slot 25. Non-conductive support rods 24 preserve the parallel spaced-apart relation between slot 25 and grid 22.

Figure 5:
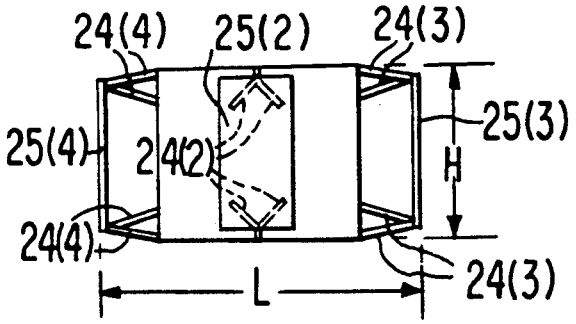
FIG. 5 is a side view of receive array 2 of the present invention, taken along view lines 5—5 of FIG. 4.

For operation in the 225 MHz to 400 MHz frequency band, it has been found that the distance D (see FIG. 4) between the centers of feed conductors 92 of adjacent antennas 20 is approximately 46.7 inches (1.58 wavelengths at 400 MHz). The height H of array 2 (see FIG. 5) is optimally 28 inches, and the length L of array 2 is optimally 66 inches. With these dimensions, the azimuth radiation pattern of array 2 is that shown in FIG. 6. Each of the four antennas 20 produces a principal lobe 28. An interference lobe 29 is formed between each adjacent pair of principal lobes 28.

For FIGS. 4 through 7, numbers within parentheses represent an index identifying which of the four antennas 20 is being illustrated.

Figure 6:
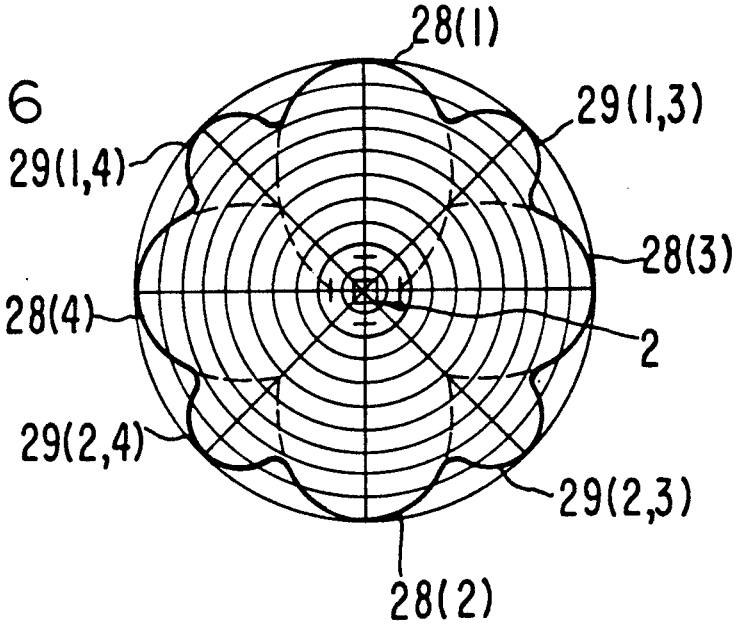
FIG. 6 is a sketch of the pattern of receive array 2 of a preferred embodiment of the present invention at 400 MHz in the azimuth plane.

FIG. 6 is the azimuth radiation pattern for 400 MHz operation. This is the worst case azimuth radiation pattern. As the frequency decreases towards 225 MHz, the interference lobes 29 become wider and the nulls between the lobes 28,29 become less deep. The principal lobes 28 retain the same geometrical configuration. It is seen that the azimuth radiation pattern is desirably nearly omnidirectional.

A nulling circuit 3, such as that illustrated in FIG. 7, can be inserted in the volume circumscribed by the four receive antennas 20, to provide further isolation between the transmit array 1 and the receive array 2. In the nulling circuit 3 illustrated in FIG. 7, signals from opposing receive antennas 20 (the geometrical relationship of the four numbered antennas 20 is defined in FIG. 4) are combined. Thus, antennas 20(1) and 20(2) are combined via cables 30 to 180° out-of-phase ports of signal combiner 31A. Similarly, antennas 20(3) and 20(4) are combined via cables 30 to 180° out-of-phase ports of signal combiner 31B. The combined signal outputs of the combiners 31 are fed via cables 32 (and through optional band pass filters 96A,96B, low-noise amplifiers 33A,33B, and cables 34) to 90° out-of-phase ports of hybrid signal combiner 35. The output of hybrid signal combiner 35 is fed via cable 95 to receiver 6, which may be at a location remote from the antenna. Cables 30 preferably have equal lengths to preserve the phasing. Similarly, cables 32 preferably have equal lengths to preserve the phasing. Similarly, cables 34 preferably have equal lengths to preserve the phasing.

By this arrangement, the four receive antennas 20 are 90° out-of-phase with respect to each other as one passes sequentially from antenna 20 to adjacent antenna 20. From the point of view of receiver 6, this effectively attenuates the signal emitting from transmit dipole array 1, since geometrically opposing antennas 20 are 180° out-of-phase with respect to the transmit signal. Signals from remote locations that the operator wants to receive will, in the worst case, hit two antennas 20 equally, creating within network 3 two signals that are 90° out-of-phase, not 180° out-of-phase. Therefore, the desired signal will never be attenuated too badly.

Band pass filters (BPF's) 96 and low noise amplifiers (LNA's) 33 are optional; when used, they compensate for undesired out-of-band signals and for the attenuation caused by combiners 31 and 35, respectively. Cables 30 must be phase and amplitude balanced, to preserve the nulling characteristics of circuit 3. This can be accomplished by means of inserting variable phase shifters and potentiometers, respectively, into circuit 3.

Even without the use of a diffraction grating 5, the present invention features at least 60 dB isotropic isolation between the transmit and receive portions of the antenna, as seen from the following breakdown:

| PARAMETER | ISOLATION (dBi) | GAIN (dBi) |
|---|---|---|
| Nulling Circuit 3 | 14 | |
| Free Space Loss | 27 | |
| Pattern Null Receive | 17 | |
| Pattern Null Transmit | 17 | |
| Gain of Transmit Array 1 | | 6 |
| Gain of Receive Array 2 | | 9 |
| Total Isolation at Antenna Port | 60 | |

The above isolation analysis used conservative estimates, such as maximum 2.4" movement of the top portion of transmit dipole array 1; 2:1 VSWR of each receive antenna 20; 1.4:1 VSWR of each combiner 31,35; and 0.5 dB cable 30,32,34 insertion loss.

FIG. 8 shows typical insertion losses in dB for the various components of nulling circuit 3. Components to the right of the dashed line can be located in a shelter 7 remote from the antenna. Band pass filter 96, which provides filtering to prevent undesired distortion in LNA 33 caused by out-of-band signals, is assumed to have practically no loss. A suitable LNA 33 for use in the present invention is model HPM-2001 made by Microwave Modules & Devices. This LNA 33 has a noise figure of 4.0 dB, a typical gain of 10 dB, a typical 1 dB compression of 10 dBm, a typical third order output intercept point of 40 dBm, and an input power rating of 27 dBm maximum. A typical receiver 6 will have a noise figure of 10 dB and a third order input intercept point of 15 dBm. Using the above information, the total noise figure of the string of components illustrated in FIG. 8 is 10 dB. This is desirable, because it means that the overall noise figure is the same as the noise figure of receiver 6. This means that the components appearing between antenna 20 and receiver 6 will not degrade the sensitivity of receiver 6.

The third order output intercept degradation of the string of components illustrated in FIG. 8 has been calculated to be −0.05 dB. This is very insignificant.

A suitable panel antenna 20 for use in the present invention is model MVP300 manufactured by C&S Antennas of England. A suitable transmit dipole array 1 is model AS-1097 manufactured by R. A. Miller. A suitable 180° power combiner 31 is model 8064 manufactured by Anzac. A suitable 90° hybrid Power combiner 35 is model 3029 manufactured by Narda. A suitable phase shifter is model 3752 manufactured by Narda. A suitable potentiometer is model 5001 manufactured by Wavetek. A suitable cable 30,32,34,94,95 is model CLL-50375 semi-rigid coaxial cable manufactured by Times Wire & Cable. A suitable band pass filter 96 is Model B110 manufacturing by K&L Microwave.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention. For example, one could operate the antenna in a reciprocal mode in which receive array 2 is used for transmit and transmit array 1 is used for receive. In this case, higher powered components 20,31,33,35 might have to be used, because normally much more power is associated with transmit than with receive.

What is claimed is:

1. A stationary antenna capable of full duplex operation and having a near omnidirectional radiation pattern in the azimuth plane for both transmitting and receiving, said antenna comprising:

a receive array consisting of four receive antenna elements each having a beamwidth of approximately 90° in the azimuth plane, said receive antenna elements arranged symmetrically about a midpoint lying in the azimuth plane, such that the beams of the four antenna elements face away from the midpoint and cover the full azimuth plane;

a transmit dipole array consisting of a colinear set of dipole elements arranged within a non-conductive cylinder that is orthogonal to the azimuth plane and centered on said midpoint;

interposed between the receive array and the transmit dipole array, cavityless means for providing at least 60 dB of electromagnetic isolation over a 50% bandwidth between said transmit dipole array and said receive array when said antenna is transmitting and receiving simultaneously in the same frequency band; and phasing means for causing signals received by geometrically opposing receive antenna elements to be 180° out of phase with respect to each other.

2. The antenna of claim 1 wherein said means for providing electromagnetic isolation comprises a planar diffraction grating that is parallel to the azimuth plane, physically separates the transmit dipole array from the receive array, and is not electrically coupled to either the transmit dipole array or the receive array.

3. 3. The antenna of claim 1 wherein said receive array and said transmit dipole array are arranged to operate in a reciprocal mode using said receive antenna elements that are operable at higher power-handling capability than that is transmitted through said receive array and as second signal of the dipole elements such that a first signal is received through said transmit dipole array.

4. The antenna of claim 1 wherein the transmit dipole array protrudes from a first side of said receive array, said antenna further comprising a cylindrical mast colinear with said transmit dipole array and disposed to support a second side of said receive array opposite to said first side, said mast mechanically supporting the transmit dipole array and the receive array, said mast further containing therewithin first and second coaxial cables which are coupled to said transmit dipole array and to said receive array, respectively.

5. The antenna of claim 1 wherein said means for providing electromagnetic isolation comprises, electrically coupled to the receive array and situated within the volume formed by the four receive antenna elements, a network for attenuating, from the point of view of the receive array, signals transmitted from said transmit dipole array, said network contributing at least 14 dB of the provided electromagnetic isolation.

6. A stationary antenna capable of full duplex operation and having a near omnidirectional radiation pattern in the azimuth plane for both transmitting and receiving, said antenna comprising:

a receive array consisting of four receive antenna elements each having a beamwidth of approximately 90° in the azimuth plane, said receive antenna elements arranged symmetrically about a midpoint lying in the azimuth plane, such that the beams of the four antenna elements face away from the midpoint and cover the full azimuth plane; and a transmit dipole array consisting of a colinear set of dipole elements arranged within a non-conductive cylinder that is orthogonal to the azimuth plane and centered on said midpoint;

wherein each receive antenna element is a panel antenna comprising a planar conductive grid generally in the shape of a square and a skeleton slot generally in the shape of an oblong, with the slot being in spaced parallel relation to the grid.

7. A stationary antenna capable of full duplex operation and having a near omnidirectional radiation pattern in the azimuth plane for both transmitting and receiving, said antenna comprising:

a receive array consisting of four receive antenna elements each having a beamwidth of approximately 90° in the azimuth plane, said receive antenna elements arranged symmetrically about a midpoint lying in the azimuth plane, such that the beams of the four antenna elements face away from the midpoint and cover the full azimuth plane;

a transmit dipole array consisting of a colinear set of dipole elements arranged within a non-conductive cylinder that is orthogonal to the azimuth plane and centered on said midpoint;

interposed between the receive array and the transmit dipole array, cavityless means for providing at least 60 dB of electromagnetic isolation over a 50% bandwidth between said transmit dipole array and said receive array when said antenna is transmitting and receiving simultaneously in the same frequency band; said means for providing electromagnetic isolation comprising, electrically coupled to the receive array and situated within the volume formed by the four receive antenna elements, a network for attenuating, from the point of view of the receive array, signals transmitted from said transmit dipole array, said network contributing at least 14 dB of the provided electromagnetic isolation;

wherein the network comprises a circuit containing signal combiners for phasing signals received by the receive antenna elements in such a way that signals from geometrically opposing receive antenna elements are 180° out of phase with respect to each other, thereby greatly attenuating signals emanating from said transmit dipole array.

* * * * *